US005707733A

United States Patent [19]

Kurt et al.

[11] Patent Number: 5,707,733

[45] Date of Patent: Jan. 13, 1998

[54] NYLON -6,6 MONOFILAMENTS FOR PRECISION WOVENS

[75] Inventors: Max Kurt, Rothenburg; Paul Schaffner, Kriens, both of Switzerland

[73] Assignee: Rhone-Poulenc Viscosuisse SA, Emmenbrucke, Switzerland

[21] Appl. No.: 718,420

[22] PCT Filed: Feb. 5, 1996

[86] PCT No.: PCT/CH96/00042

§ 371 Date: Sep. 20, 1996

§ 102(e) Date: Sep. 20, 1996

[87] PCT Pub. No.: WO96/24711

PCT Pub. Date: Aug. 15, 1996

[30] Foreign Application Priority Data

Feb. 9, 1995 [CH] Switzerland ..... 383/95

[51] Int. Cl.[6] ..... D07G 3/00

[52] U.S. Cl. ..... 426/364; 428/395

[58] Field of Search ..... 428/364, 395

[56] References Cited

U.S. PATENT DOCUMENTS 4,652,488 3/1987 Willemsen et al. ..... 428/395

5,405,696 4/1995 Cuculo et al. ..... 428/364

5,419,964 5/1995 Boles ..... 428/364

OTHER PUBLICATIONS

Hans Peter Lisson, Ceranyl—das Siebdruckgewebe fuer die Fliesenindustrie, May 1992 (No Translation).

*Primary Examiner*—Newton Edwards

*Attorney, Agent, or Firm*—Michael J. Striker

[57] ABSTRACT

The invention concerns a polyamide-66-monofilament with improved initial modulus and with a titre of dtex 4 fl–150 fl. The strength of the monofilaments is at least 60 cN/tex for an extension of less than 25% and the specific LASE, in relation to the initial titre at 2% is at least 7.5 cN/tex, at 5% at least 18 cN/tex and at 10% at least 40 cN/tex, and the dry relaxation is less than 25%. The result is an improvement of about 40% in the LASE at 2% and an improvement of about 35% in the wet relaxation compared to standard polyamide (PA 66) monofilament. The precision fabric manufactured from the monofilaments disclosed is particularly suitable for direct use in direct printing onto woven fabrics and hollow articles.

3 Claims, 2 Drawing Sheets

NYLON -6,6 MONOFILAMENTS FOR PRECISION WOVENS

The invention relates to dimensionally stable nylon-6,6 monofilaments having a linear density of 150 dtex for producing precision wovens.

Screen printing generally employs precision wovens composed of polyester (PET). The reason for this preference over polyamide is the distinctly higher modulus and the lower relaxation, i.e. lower tension loss of tensioned screens, of PET. A high precision woven modulus means better consistency in the tensioning process and also a higher printing precision due to a higher return force. Low relaxation has a positive effect on printing screen life.

The situation is different in direct tile printing. This sector employs pigment dyes which are very abrasive. It is known that the resistance to these dyes of polyamide precision wovens is distinctly higher than that of polyester precision wovens, so that the specific advantages and disadvantages of polyester and polyamide are roughly in balance. For this reason, polyamide is frequently used in direct tile printing as well as polyester. Attempts at achieving decisive improvements in the modulus and relaxation characteristics of polyamide wovens in the direction of polyester wovens by optimizing the weaving step have already been tried (H. P. Lisson, Serigraphie/-Siebdruckpraxis 5/92, pages 36–43). The polyamide woven obtained does show certain improvements over the normal polyamide fabric, but these improvements are still insufficient as regards the modulus and the relaxation characteristics of the monofilaments.

It is an object of the invention to provide a monofilament which has a distinctly higher modulus than the standard polyamide filament.

It is the further object to improve the relaxation or tension loss in an aqueous medium so as to achieve at least the level of polyester.

It is a further object to provide monofilaments which make it possible to produce precision wovens, especially for direct tile and hollow body printing, with the desired properties without additional operation.

The object according to the invention is achieved when the monofilaments have a breaking strength of at least 60 cN/tex, a breaking extension of less than 25%, a specific LASE 2%, based on the original linear density, of at least 7.5 cN/tex, a specific LASE 5%, based on the original linear density, of at least 18 cN/tex, a specific LASE 10%, based on the original linear density, of at least 40 cN/tex, and a dry relaxation of less than 25%.

It is surprising that the monofilaments according to the invention are effective in producing a precision woven having an approximately 25% higher modulus (T10 value) and an approximately 50% improved relaxation characteristic compared with the prior art. The woven obtained is also notable for a very uniform appearance, and the likelihood of warp thread breakages in weaving is much reduced.

The retardation reflects the creep characteristics of a thermoplastic monofilament. A monofilament retardation of less than 8% is particularly advantageous. A retardation in the monofilament of more than 8% leads to insufficient dimensional stabilities in the finished fabric.

Methods of Measurement

The mechanical properties of the monofilaments were measured according to the standards DIN 53815 and DIN 53834.

The retardation (creep) of the filaments was measured by weighting a monofilament with a tension of 2.5 cN/dtex and then recording the lengthening as a function of time. The retardation is reported in percent of the original length after a retardation time of 120 minutes.

The relaxation of the filaments in the dry state was measured by weighting a monofilament with a tension of 2.5 cN/dtex and then recording the tension loss as a function of time. The relaxation is reported in percent of the original tension after a relaxation time of 60 minutes.

The wet relaxation of the monofilament is measured in line with the tensioning process and the subsequent use of a screen in actual screen printing. As with the tensioning of a woven on a stenter, the thread is first pulled and held for 10 minutes with a constant specific force of 2.5 cN/dtex (dry lengthening or retardation). This is followed by the actual measurement of the relaxation by keeping the length of the thread constant and measuring the tension decrease over 10 minutes (dry relaxation). Following this dry phase, the threads, still kept at a constant length, are immersed in water and the tension decrease is again recorded over 30 minutes (wet relaxation). The difference in the tension measurements before and after the relaxation phase (10 min dry and 10 min wet) is the wet relaxation. The value is reported in percent.

In the force/elongation diagrams of woven strips, the curve, especially in the lower elongation range, is strongly dependent on the warp and weft crimp in the woven fabric. Depending on the weaving and finishing conditions, for example, the weft can lie relatively uncrimped in the plane of the fabric, while the warp thread has a pronounced wavy configuration. This leads to very different values, especially in relation to the reference forces, i.e. the forces measured at stated elongations. To offset the interaction between warp and weft in the fabric due to crimp, the reference forces in the fabric should always be determined in both directions or the arithmetic average of warp and weft formed. To minimize the effect of woven-fabric crimp and to obtain a result effectively corresponding with the thread properties, the fabric samples are measured with a pretensioning force of 1.0 cN/dtex. The measurement was carried out on fabric strips 5 cm in width using a clamped length of 200 mm in accordance with DIN method 53857.

The relaxation of a woven fabric in the wet medium was measured by producing screens of size 43×53 cm from the various precision wovens. In this process, the precision wovens were pretensioned to 25 N/cm on a tensioner, then adhered, sealed and stored for 5 days. The measurement of the wet relaxation was carried out afterwards. To this end, the original tension of the screen was measured, the screen was then placed in water for 24 hours and the tension was then measured again following the elimination of the surface water. The wet relaxation is the difference in the tension measurements before and after the waterbath. The value is reported in % tension loss.

The invention will now be illustrated with reference to examples.

OPERATIVE EXAMPLE 1

(Filament Production)

Nylon-6,6 filaments were melt-spun at a spinning speed of 320 m/min. The applied total draw ratio of 4.70 resulted in a wind-up speed of 1510 m/min. The temperature of the delivery godets was in each case 70° C., and one of the draw godets was varied between 180° and 220° C.

Table 1 presents various variants with their most important process settings and filament properties. In addition, a standard polyamide monofil (variant 1) was included in the testing.

TABLE 1

| Variant | | 1* | 2 | 3 | 4 |
|---|---|---|---|---|---|
| Drawing conditions: | | | | | |
| Total draw ratio | [–] | 4.0 | 4.7 | 4.7 | 4.7 |
| Delivery temperature | [°C.] | 70 | 70 | 70 | 70 |
| Drawing temperature | [°C.] | 180 | 220 | 220 | 220 |
| Relaxation ratio | [–] | 0.95 | 1.00 | 1.00 | 1.00 |
| Wind-up speed | [m/min] | 1240 | 1510 | 1510 | 1510 |
| Filament properties: | | | | | |
| Linear density | [dtex] | 46.0 | 47.1 | 33.6 | 22.4 |
| Tenacity | [cN/tex] | 53.7 | 69.7 | 70.7 | 71.1 |
| Breaking extension | [%] | 36.0 | 21.9 | 21.7 | 19.6 |
| LASE 2% | [cN] | 25.9 | 38.1 | 31.0 | 22.2 |
| spec. LASE 2% | [cN/tex] | 5.6 | 8.1 | 9.2 | 9.9 |
| LASE 5% | [cN] | 52.6 | 95.1 | 72.8 | 55.3 |
| spec. LASE 5% | [cN/tex] | 11.4 | 20.2 | 21.7 | 24.7 |
| LASE 10% | [cN] | 125 | 208 | 160 | 121 |
| spec. LASE 10% | [cN/tex] | 27.2 | 44.2 | 47.6 | 54.0 |
| Boil-off shrinkage | [%] | 6.4 | 7.7 | 8.2 | 8.1 |
| Hot air shrinkage 160° C. | [%] | 3.7 | 4.8 | 5.1 | 5.2 |
| Hot air shrinkage 190° C. | [%] | 5.1 | 6.4 | 6.5 | 6.4 |
| Dry relaxation | [%] | 26.8 | 21.9 | 19.3 | 18.4 |
| Wet relaxation | [%] | 31.7 | 20.2 | — | — |
| Retardation | [%] | 10.5 | 6.2 | 6.6 | 6.3 |

*Standard nylon-6,6 monofil

OPERATIVE EXAMPLE 2

(Fabric Production)

The production of the loomstate fabric (fabrication stage 1) was carried out on conventional weaving machines. Warp and weft have the same diameter. The linear density is 47 dtex.

In the finishing stage (fabrication stage 2) the fabric is treated in one or more thermal finishing steps so as to produce, in the finished fabric, a symmetry of the thread counts in warp and weft of +/–1 thread/cm and also symmetrical force/elongation characteristics.

In a weaving trial, filament variant 2 was used in both warp and weft. Table 2 shows the arithmetic average of the warpways and weftways reference forces at 10% (T10 value) and the wet relaxation of a finished precision fabric from filament variant 2 in comparison with a standard precision fabric (from filament variant 1). It is evident that the precision fabric from filament type 2 has an approximately 25% higher T10 value and an approximately 50% improved wet relaxation.

TABLE 2

| Variant | | 2 | 1* |
|---|---|---|---|
| T10 value | [daN/cm] | 10.4 | 8.1 |
| Spec. T10 value | [cN/tex] | 36.3 | 28.7 |
| Thread count | [threads/cm] | 58 | 58 |
| Wet relaxation | [%] | 8.5 | 16.2 |

*Standard nylon-6,6 precision fabric

BRIEF DESCRIPTION OF THE DRAWING

The results of the invention are further explained in a drawing, where.

Figure 1:
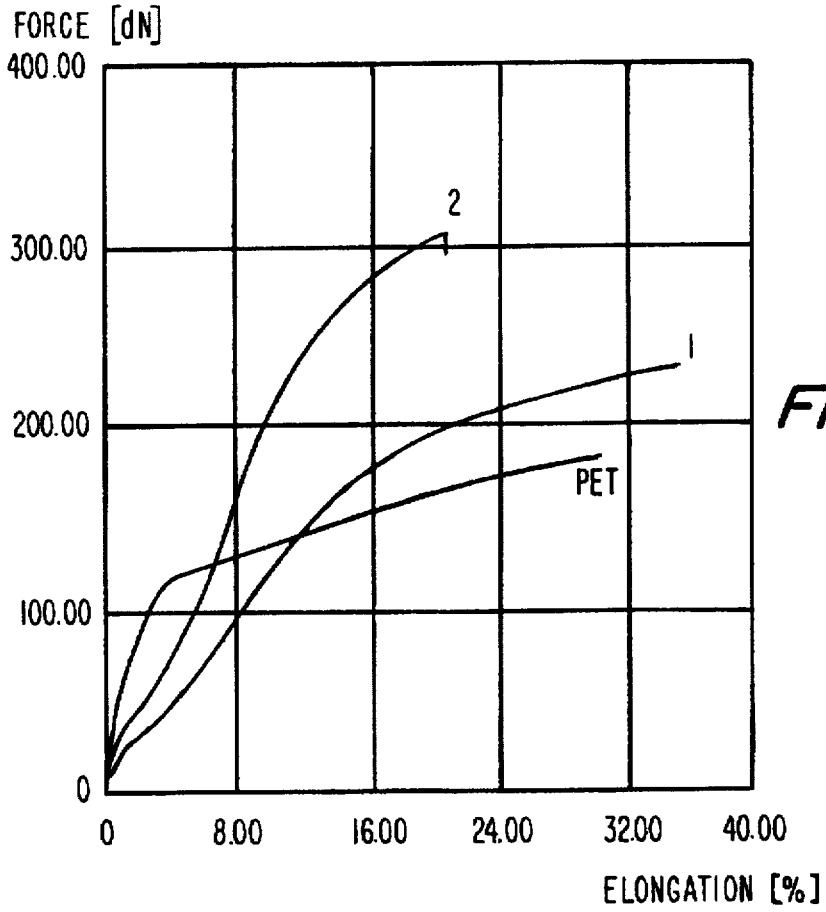
FIG. 1 shows the force/elongation diagrams of the monofilaments according to the invention in comparison with known polyamide and polyester monofilaments.

It is evident from the force/elongation diagrams of FIG. 1 that type 2 according to the invention has a significantly higher modulus than the standard PA 6,6 type 1. However, compared with the polyester it is clearly visible that the latter still has a distinctly steeper curve gradient, especially in the lowest range of the elongation.

Figure 2:
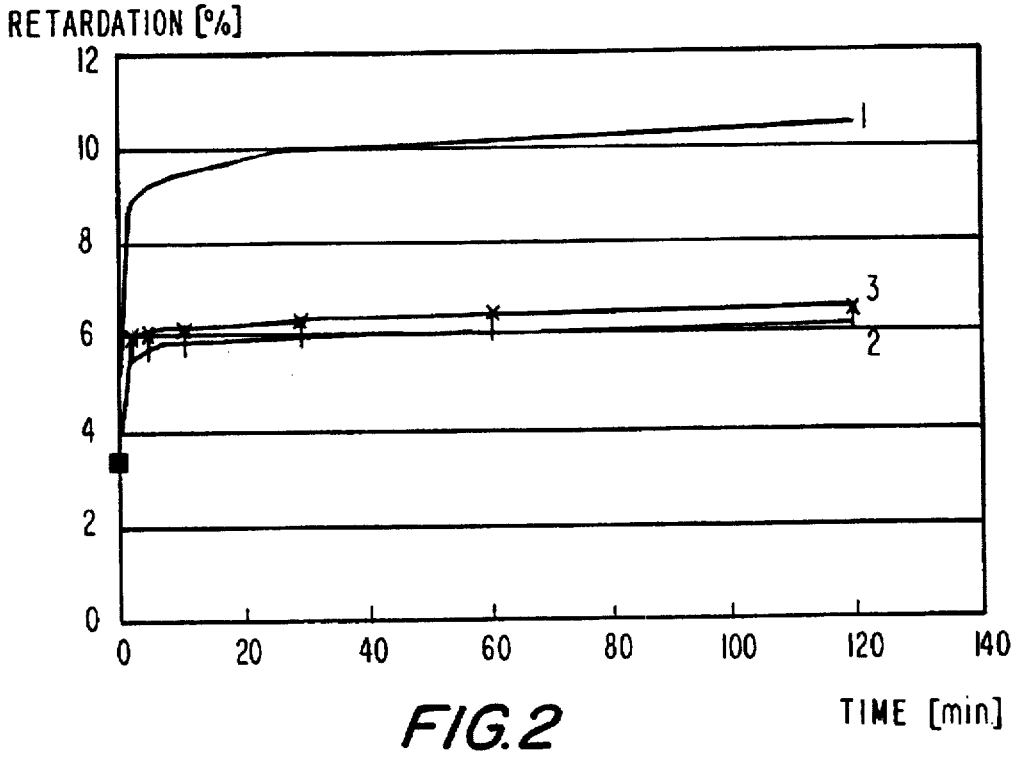
FIG. 2 shows the corresponding retardation curves (creep)

FIG. 2 shows the retardation curves (creep) of PA standard type 1 and the two monofil types 2 and 3 according to the invention. It is evident that these, having a retardation of 6.2% and 6.6%, respectively, are distinctly better than the standard type at 10.5%.

The retardation curves were recorded by weighting the filaments with a tension of 2.5 cN/dtex and then measuring the lengthening over time, recorded in % relative to the original length.

Figure 3:
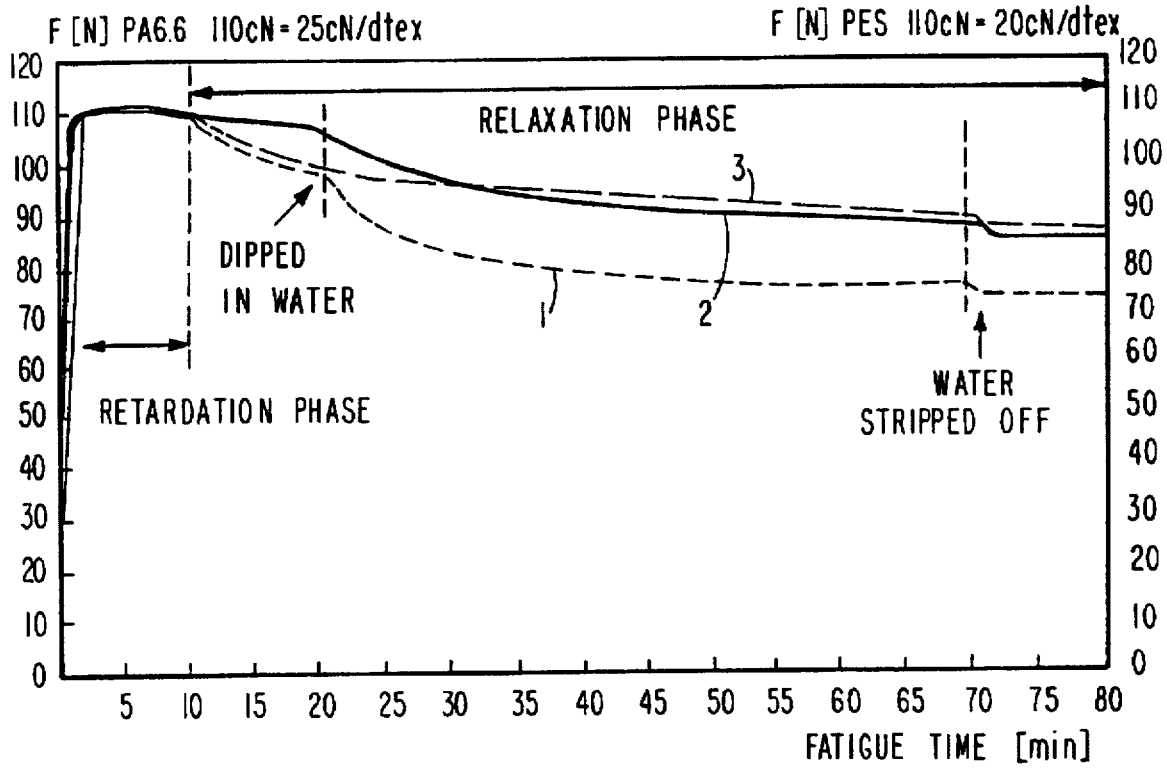
FIG. 3 shows the relaxation characteristics of the monofilament according to the invention.

FIG. 3 shows the relaxation under near-production conditions of monofilament 2 according to the invention in comparison with a standard nylon-6,6 monofilament (PA 66) 1 and a standard polyester (PET) monofilament 3. The monofilaments were dry relaxed for 10 min before the addition of water. After dry relaxation, the monofilament according to the invention, at 2.8%, shows distinctly the lowest relaxation compared with the standard PA66 monofilament at 11.1% and PET at 9.1%. On addition of water, the monofilament according to the invention shows after 60 min a total relaxation (amount of dry relaxation and amount of wet relaxation) of 20.2%, compared with the 31.7% of the standard PA66 monofilament. In addition, the monofilament according to the invention lies within the range of a polyester monofilament, which has a total relaxation of 18.2% following the water treatment.

Figure 4:
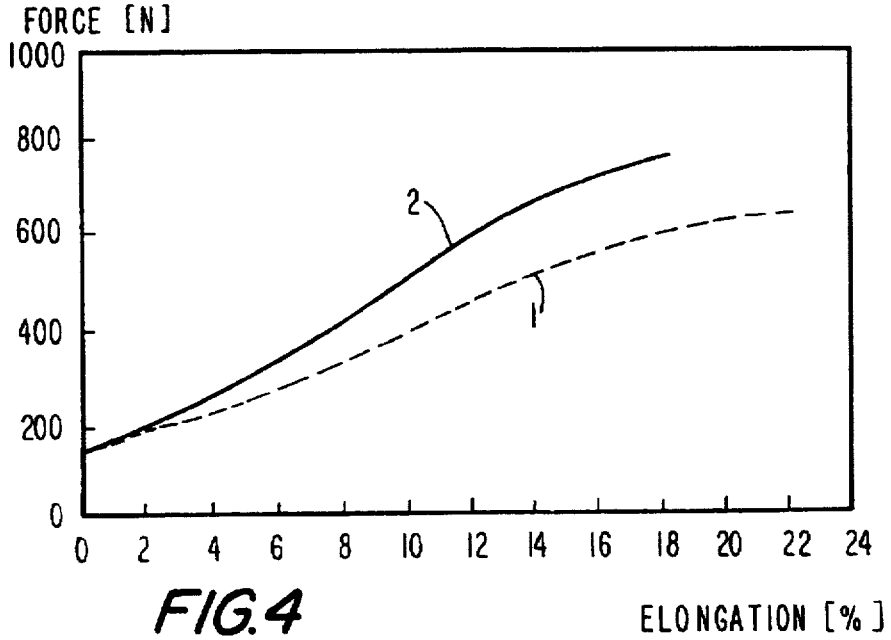
FIG. 4 shows the force/elongation diagram of the precision fabric, averaged over warp and weft, comprising the monofilament according to the invention in comparison with known polyamide precision fabric.

FIG. 4 shows the force/elongation diagram, averaged over warp and weft, of the precision fabric from monofilament 2 according to the invention in comparison with known polyamide precision fabric 1 (fabric strips each 5 cm in width). It is evident that the modulus of the fabric composed of monofilament 2 according to the invention lies distinctly above that of the standard nylon-6,6 fabric 1.

The polyamide monofilament according to the invention, without chemical modifications of the polymer, advantageously combines the screen printing properties of a polyamide with those of polyester. Compared with the standard nylon-6,6 monofilament, the LASE at 2% represents an improvement of about 40% and the wet relaxation an improvement of about 35%. The monofilament is suitable for precision wovens, preferably for use in direct tile and hollow body printing.

We claim:

1. Dimensionally stable nylon-6,6 monofilaments having a linear density of 4–150 dtex for producing precision wovens, characterized in that the monofilaments have a breaking strength of at least 60 cN/tex, a breaking extension of less than 25%, a specific LASE 2%, based on the original linear density, of at least 7.5 cN/tex, a specific LASE 5%, based on the original linear density of at least 18 cN/tex, a specific LASE 10 based on the original linear density, of at least 40 cN/tex, and a dry relaxation of less than 25%.

2. Polyamide monofilaments according to claim 1, characterized by a wet relaxation of less than 25%.

3. Polyamide monofilaments according to claim 1, characterized by a retardation of less than 8%.

* * * * *